United States Patent [19]

Reed et al.

[11] 4,116,569

[45] Sep. 26, 1978

[54] BALL HOLDER FOR A BALL-POINT PEN

[75] Inventors: Meuriel Francis Reed, North Reading; Curtis Lawrence Malm, Quincy, both of Mass.

[73] Assignee: The Gillette Company, Boston, Mass.

[21] Appl. No.: 768,479

[22] Filed: Feb. 14, 1977

[51] Int. Cl.[2] ..... B43K 7/10

[52] U.S. Cl. ..... 401/216

[58] Field of Search ..... 401/216, 209–215, 401/217

[56] References Cited

U.S. PATENT DOCUMENTS

| | | | |
|---|---|---|---|
| 2,390,636 | 12/1945 | Biro | 401/216 |
| 2,536,124 | 1/1951 | Bolvin et al. | 401/216 |
| 2,627,247 | 2/1953 | Reed | 401/216 X |
| 3,781,123 | 12/1973 | Linz et al. | 401/216 |

FOREIGN PATENT DOCUMENTS

| | | | |
|---|---|---|---|
| 2,059,259 | 12/1970 | Fed. Rep. of Germany | 401/216 |
| 847,552 | 9/1960 | United Kingdom | 401/216 |

*Primary Examiner*—Stephen C. Pellegrino

*Attorney, Agent, or Firm*—Richard A. Wise; Donald E. Mahoney

[57] ABSTRACT

A ball holder for a ball-point pen is arranged to have a ball socket with a ball seat having a plurality of convex surfaces formed on concave shoulder surfaces. A writing ball inserted in the ball socket is supported by a single ball contact point on each of the ball seat convex surfaces. Concavities are provided between adjacent convex surfaces and shoulder surfaces for collecting and supplying ink to a surface of the writing ball.

3 Claims, 4 Drawing Figures

BALL HOLDER FOR A BALL-POINT PEN

BACKGROUND OF THE INVENTION

1. Field of the Invention

This invention relates to ball-point pens and, more particularly, to a ball-point pen having a ball socket with a ball seat comprising a plurality of convex surfaces.

2. Description of the Prior Art

Prior art ball-point pens include a ball holder comprising a ball holder body with a hollow interior for containing an ink source, a ball socket formed at a tip of the body with a crimped rim to retain a ball within the socket, a ball seat disposed within the body inwardly or communicatively with the ball socket, and an ink feed system extending from the ball seat to the hollow interior of the body for supplying ink to a surface of the ball. It is desirable to arrange the ink feed system to provide a flow of ink which would adhere uniformly to the ball surface so that the ball would provide a uniform ink laydown when rotated across a writing surface. A type of known ink feed system having a plurality of narrow capillary channels with a star-shaped cross section is particularly suitable for supplying ink to the ball. However, the narrow capillary channels are susceptible to clogging by foreign matter which sometimes infiltrate into the ball socket. A clogged channel obstructs the flow of ink to the ball causing a non-uniform ink coating on the ball surface resulting in writing irregularities, such as skipping or thinning of written lines.

Prior art ball holders are arranged to minimize skipping or thinning of written lines by extending a relatively large diameter ink feed port between the hollow interior of the body and the ball seat. In addition, concavities are formed between the ball and recesses in the ball seat. The concavities are arranged to collect ink, and supply the same uniformly, and in ample quantity, to the entire surface of the ball. Narrow grooves or capillary channels are formed at corners of the ink feed port for supplying ink by capillary action to the concavities, so that a constant quantity of ink is always stored in the concavities, while excessive feeding of ink is avoided and dripping of ink and blotching are prevented. An example of a ball holder with a ball seat including a plurality of substantially flat contact surfaces oriented to form tangent planes to the writing ball and a peripheral succession of shallow ink channels around the ball is disclosed in U.S. Pat. No. 3,703,234.

The known ball-point pens using the previously described ball holder are subject to writing irregularities when the act of writing causes the ball to eventually wear into the ball seat and the ink collecting concavities to disappear. Accordingly, it is desired to arrange a ball holder with a ball seat forming ink collecting concavities which would continue to collect and supply ink to the ball surface despite ball seat wear over the writing life of the ball-point pen.

SUMMARY OF THE INVENTION

A ball-point pen including a ball holder of the type having a tubular ball holder body with a ball socket having a cylindrical wall on an end of the body for rotatable retention of a writing ball and an ink feed port extending from the ball socket to a reservoir is improved by including a novel ball seat at a bottom of the ball socket. The ball seat has a plurality of convex surfaces formed on concave shoulder surfaces to provide a single ball contact point on each of the convex surfaces. Concavities are provided between adjacent convex surfaces and shoulder surfaces for collecting and supplying ink to a surface of the writing ball.

DESCRIPTION OF THE PREFERRED EMBODIMENT

Figure 1:
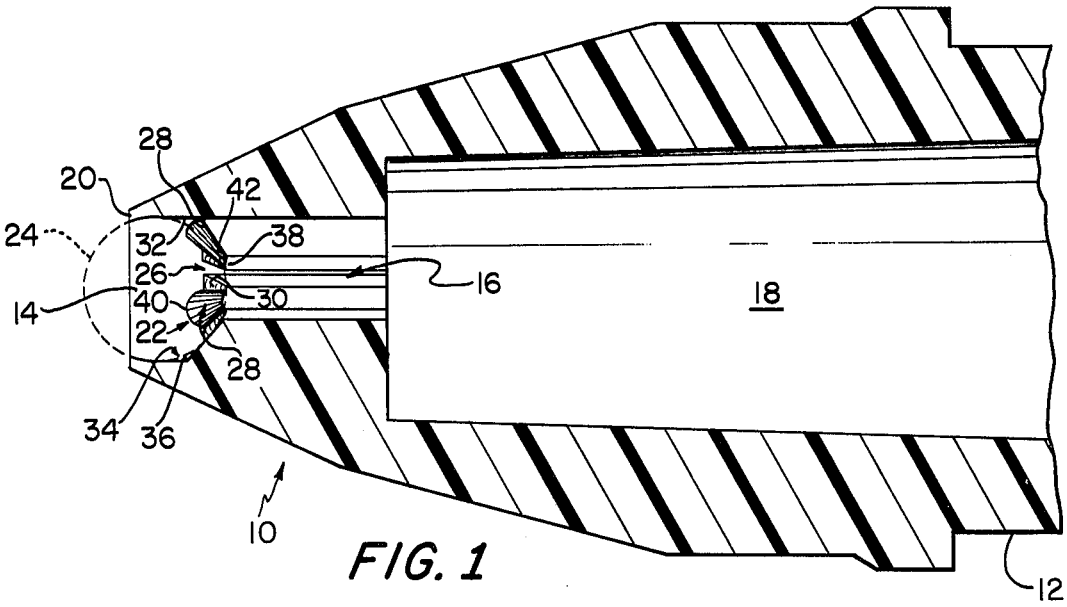
FIG. 1 is a longitudinal view of a ball holder arranged according to the invention.
Figure 3:
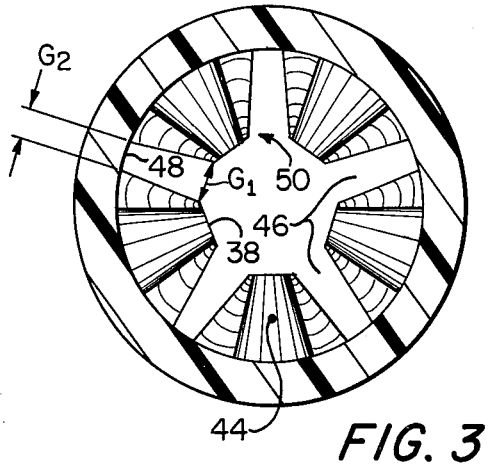
FIG. 3 is an end view of the ball seat of the ball holder.
Figure 2:
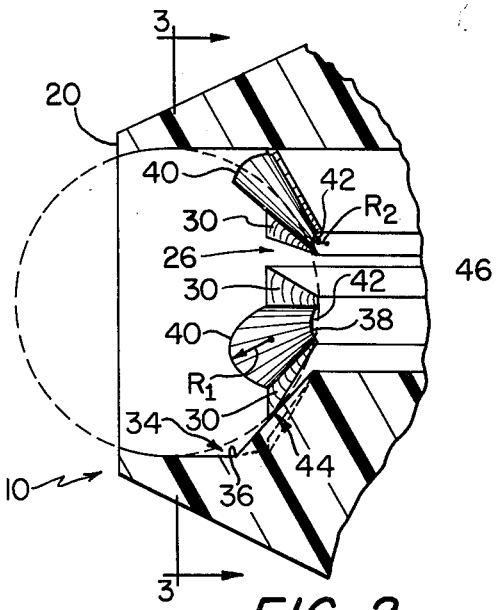
FIG. 2 is an enlarged view of a ball seat of the ball holder.
Figure 4:
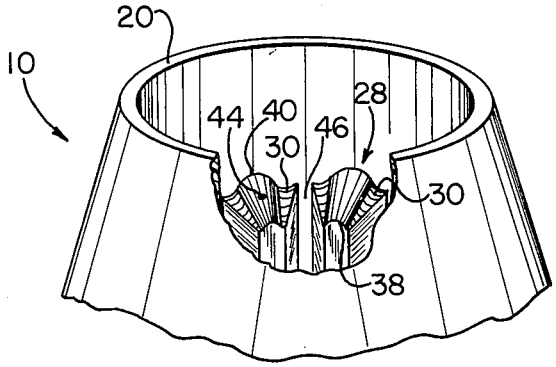
FIG. 4 is a fragmentary perspective view, partially cut away, of the ball seat of the ball holder.

Referring to FIGS. 1, 2, 3 and 4, there is shown a ball holder 10 comprising a tubular ball holder body 12 with first, 14, second, 16, and third, 18, lengthwise cylindrical and substantially coaxial cavities or bores. The first cavity 14 extends from a forward extremity or tip 20 of the body 12 to a novel ball seat 22 and is adapted to function as a ball socket. For example, the diameter of the first cavity 14 may be 0.0321 inch to receive a 0.0315 inch ball. The second cavity 16 extends from a bottom of the ball seat 22 to the third cavity 18 acting as an ink reservoir. The second cavity 16 operates as an ink feed port for supplying ink, not shown, contained in the third cavity 18 to the ball seat 22 by capillary action to cover or coat a surface of a ball 24 disposed in the socket 14. The ball 24 may be assembled in the socket 14 by inserting the ball 24 through a socket opening at the tip 20 and then crimping or bending the tip inwardly to retain the ball 24 in the socket 14 with sufficient clearance to permit the ball 24 to freely rotate. The ball holder 10 may be injection molded from synthetic resin material to form an ink feed channel 16 with a 0.013 inch diameter and a 0.30 inch long ink reservoir 18 with a 0.064 inch diameter for containing an ink-saturated fibrous rod, not shown. It will be appreciated that the ink coating the ball surface is transferred to a writing surface, such as paper, when the ink coated ball 24 is rotated across the writing surface.

According to the invention, the ball seat 22 and ink feed port 16 are arranged to collectively store and supply ink for coating the surface of the rotating ball 24. In a preferred embodiment, the ball seat 22 comprises five concavities 26 formed between adjacent cylindrically-shaped convex surfaces 28 integrally mounted on concave shoulder surfaces 30 extending from a wall 32 of the socket 14. Concavities 34 or recesses are also provided around the ball 24 at the boundary 36 between the ball seat 22 and the socket wall 32. The concavities 26 are arranged to collect ink and supply the same to the ball surface as the ball 24 is rotated in the socket 14. The convex surfaces 28 and shoulder surfaces 30 are inclined and slope inwardly from the socket wall 32 toward the ink reservoir 18 to an edge 38 of the second cavity 16 or ink feed port. Writing smoothness of a ball-point pen is improved if the ball 24 is supported in the ball socket 14 by a plurality of surfaces each presenting one distinct ball contact point. In the prior art, the ball contact points are located at the edge 38 of the ink feed port 16, whereby ball seat wear caused by the rotating ball 24 tends to be localized around the ink feed port 16. Unlike the prior art, the cylindrically-shaped convex surfaces 28 have a base portion 40 with a radius, $R_1$, at the socket wall 32 that is substantially equal to a radius, $R_2$, of a convex section 42 at the ink feed port edge 38. The convex surfaces 28 are inclined so that the ball 24 is supported by each of the convex surfaces 28 at a distinct ball contact point 44 located intermediate the edge 38 of the ink feed port 16 and the socket wall 32, whereby ball seat wear is directed into the convex surfaces 28 without drastically reducing the ink collecting capabilities of the ball seat concavities 26.

Narrow grooves 46 longitudinally extending from the first cavity 14 to the third cavity 18 separate adjacent shoulder surfaces 30 from the ink feed port 16 to the socket wall 32. The grooves 46 operate as capillary channels for supplying ink contained in the ink reservoir 18 to the concavities 26. It has been determined that writing characteristics of a ball-point pen are improved by maintaining a sufficient ink supply for coating a ball surface adjacent to the socket wall 32, particularly under writing conditions in which the ball 24 is very rapidly rotated in the socket 14. Thus, it is advantageous to arrange the grooves 46 to supply ink to a concavity portion 48 at the socket wall 32 at a rate that is faster than the rate of ink supplied to a concavity portion 50 near the edge 38 of the ink feed port 16. In the preferred embodiment, the grooves 46 are linearly tapered to provide a relatively wide gap, $G_1$, separating adjacent shoulder surfaces 30 around the periphery or edge 38 of the ink feed port 16 and a smaller gap, $G_2$, at the socket wall 32, whereby the rate of ink flow through the grooves 46 at the socket wall 32 is a greater than the rate of ink flow through the grooves 46 at the edge 38 of the ink feed port 16. The grooves 46 are sufficiently narrow to prevent the ink from backflowing from the ball seat concavities 26 to the ink reservoir 18. In a preferred embodiment, the gap $G_1$ is 0.005 inch and the gap $G_2$ is 0.003 inch.

An embodiment of the invention has been shown and described in FIGS. 1, 2, 3 and 4 only by way of example. Various other embodiments and modifications thereof will be apparent to those skilled in the art within the scope of the invention defined in the following claims.

What is claimed as new and desirous to be secured by Letters Patent of the United States is:

1. In a ball holder for a ball-point pen of the type having a tubular ball holder body and a ball socket with a cylindrical wall on an end of said body for rotatable retention of a writing ball, an ink reservoir extending into said body and an ink reservoir seat port extending from said ball socket to said reservoir, the improvement comprising:

a ball seat at a bottom of said ball socket, said ball seat having a plurality of convex surfaces formed on concave shoulder surfaces to provide a single ball contact point on each of said convex surfaces;

concavities between said convex surfaces adjacent to said shoulder surfaces for collecting and supplying ink to a surface of said writing ball; and linearly tapered capillary channels providing a first gap separating said adjacent shoulder portions bordering said ink seat port and a second smaller gap separating said adjacent shoulder portions at said ball socket wall.

2. A ball holder according to claim 1, wherein said convex surfaces are cylindrical sections extending from said ball socket wall to said ink feed port.

3. A ball holder according to claim 1, wherein said convex surfaces and said shoulder surfaces are inclined to slope inwardly toward said reservoir from said ball socket wall to said ink feed port.

* * * * *